US006311433B1

(12) United States Patent
Zdroik

(10) Patent No.: US 6,311,433 B1
(45) Date of Patent: Nov. 6, 2001

(54) ADJUSTABLE MANHOLE/CATCH BASIN STRUCTURE

(76) Inventor: David J. Zdroik, 3406 N. County Rd Y, Custer, WI (US) 54423

( * ) Notice: Subject to any disclaimer, the term of this patent is extended or adjusted under 35 U.S.C. 154(b) by 0 days.

(21) Appl. No.: 09/655,183

(22) Filed: Sep. 5, 2000

(51) Int. Cl.[7] ..... E02D 29/14

(52) U.S. Cl. ..... 52/20; 52/19; 404/26; 405/52

(58) Field of Search ..... 52/19, 20, 135, 52/196, 169.7; 404/26, 25; 405/52, 133

(56) References Cited

U.S. PATENT DOCUMENTS 1,408,982 * 3/1922 Calhoun .
3,533,199 * 10/1970 Pickett .
3,629,981 * 12/1971 McCaffery .
4,075,796 * 2/1978 Cuozzo .
4,255,909 * 3/1981 Soderstrom ..... 52/20
4,325,405 * 4/1982 Christo ..... 52/20
4,614,065 * 9/1986 Papp ..... 52/20
4,883,590 * 11/1989 Papp ..... 210/164
5,095,667 * 3/1992 Ryan et al. ..... 52/20
5,299,884 * 4/1994 Westhoff et al. ..... 404/25
5,944,442 * 8/1999 Roush et al. ..... 404/26
6,036,401 * 3/2001 Morina ..... 404/26
6,179,518 * 1/2000 Suatac ..... 404/26
6,266,928 * 7/2001 Argandona ..... 52/20

* cited by examiner

*Primary Examiner*—Yvonne M. Horton
(74) *Attorney, Agent, or Firm*—Donald J. Ersler

(57) ABSTRACT

An adjustable manhole/catch basin structure includes a mounting base, adjustable tube, and protection sleeve. The mounting base includes a mounting flange and an externally threaded tube which extends upward from the mounting flange. A plurality of mortar openings are formed through the mounting flange. The protection sleeve is mounted concentric with the externally threaded tube. The adjustable tube is internally threaded such that it may be threaded on to the externally threaded tube. The inner diameter of the protection sleeve is large enough to provide clearance for the outer diameter of the adjustment tube. Three notches are preferably formed in a top of the adjustment tube to allow an adjustment tool to rotate thereof to the desired height. The adjustment tool includes a body, three arms and a torque lever.

16 Claims, 4 Drawing Sheets

ADJUSTABLE MANHOLE/CATCH BASIN STRUCTURE

BACKGROUND OF THE INVENTION

1. Field of the Invention

The present invention relates generally to manhole accesses and more specifically to an adjustable manhole/catch basin structure which may be adjusted vertically to accommodate a change in road surface height.

2. Discussion of the Prior Art

An ever present problem is reconstruction of road surfaces. Typically, an added layer of asphalt is applied to a cement road which is chipped, cracked, and damaged. The result of the new layer of asphalt is that the manholes and catch basins are too low and will damage the wheels and suspensions of motor vehicles. New manhole and/or catch basins need to be installed to compensate for the increased road height. There are several patents which address adjusting the height of a manhole/catch basin for increased road height. U.S. Pat. No. 3,533,199 to Pickett, U.S. Pat. No. 3,629,981 to McCaffery, and U.S. Pat. No. 4,075,796 to Cuozzo address the issue of adjustable manholes.

However, Pickett requires that a large truck with an elaborate tool to adjust the height of the adjustable portion; the threads of the adjustable structure may become damaged when pavement is removed from around the adjustable portion; and the second frame member must be heated to rotate thereof. MaCaffery requires a gasket to seal the manhole cover. The threads on Cuozzo may become damaged when pavement is removed from around the adjustable portion.

Accordingly, there is a clearly felt need in the art for an adjustable manhole/catch basin structure which may be vertically adjusted when a road surface needs to be resurfaced.

SUMMARY OF THE INVENTION

The present invention provides an adjustable manhole/catch basin structure which may be easily adjusted vertically. The adjustable manhole/catch basin structure includes a mounting base, adjustable tube, protection sleeve, and cover. The mounting base includes a mounting flange and an externally threaded tube which extends upward from the mounting flange. A plurality of mortar openings are formed through the mounting flange. The protection sleeve is mounted concentric with the externally threaded tube. The adjustable tube is internally threaded such that it may be threaded on to the externally threaded tube. The inner diameter of the protection sleeve is large enough to provide clearance for the outer diameter of the adjustment tube. Three notches are preferably formed in a top of the adjustment tube to allow an adjustment tool to rotate thereof to the desired height. The adjustment tool includes a body, three arms and a torque lever.

The adjustable manhole/catch basin structure is placed on top of a concrete lateral. The mounting flange is mortared to the top of the concrete lateral. The adjustment tool is used rotate the adjustable tube to a height of one inch below the road grade. After the grade is set, the adjustable tube is rotated to the proper height and the pavement is filled around the adjustment tube. A manhole or catch basin cover is then placed in the adjustable tube.

Accordingly, it is an object of the present invention to provide an adjustable manhole/catch basin structure which does not have exposed threads that may be damaged during adjustment thereof.

It is a further object of the present invention to provide an adjustable manhole/catch basin structure which does not require an elaborate tool to adjust the height thereof.

Finally, it is another object of the present invention to provide an adjustable manhole/catch basin structure which does not require sealing gaskets for use with a manhole cover.

These and additional objects, advantages, features and benefits of the present invention will become apparent from the following specification.

DETAILED DESCRIPTION OF THE PREFERRED EMBODIMENTS

Figure 2:
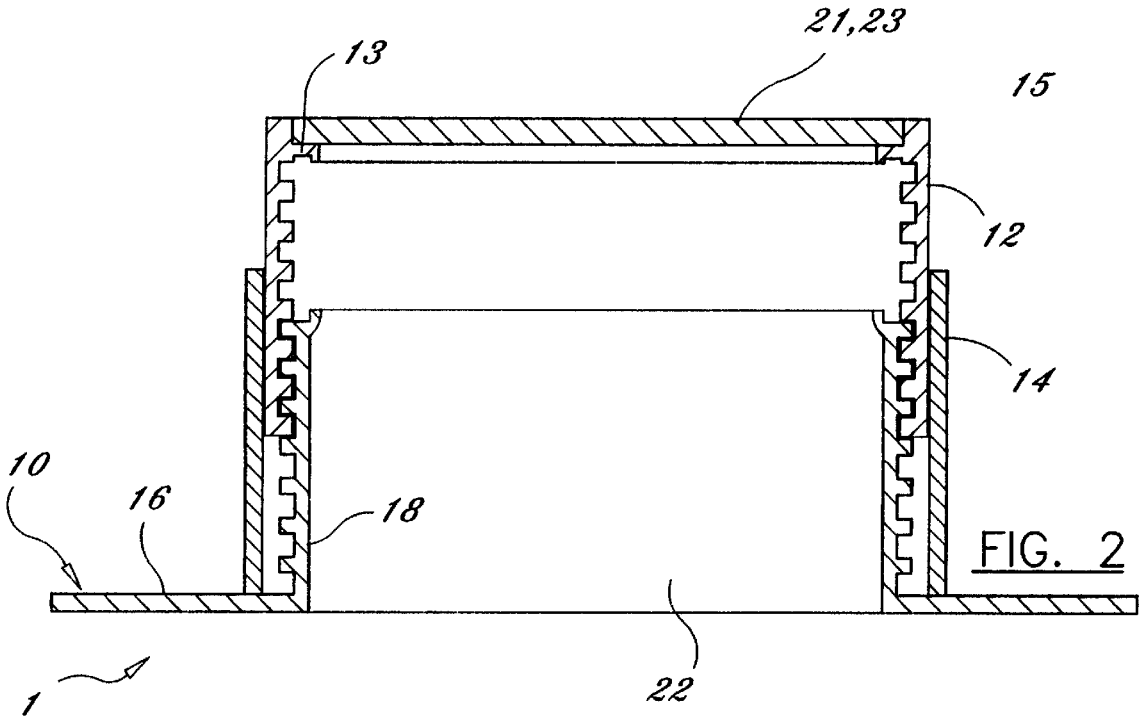
FIG. 2 is a cross-sectional view of an adjustable manhole/catch basin structure in accordance with the present invention.
Figure 3:
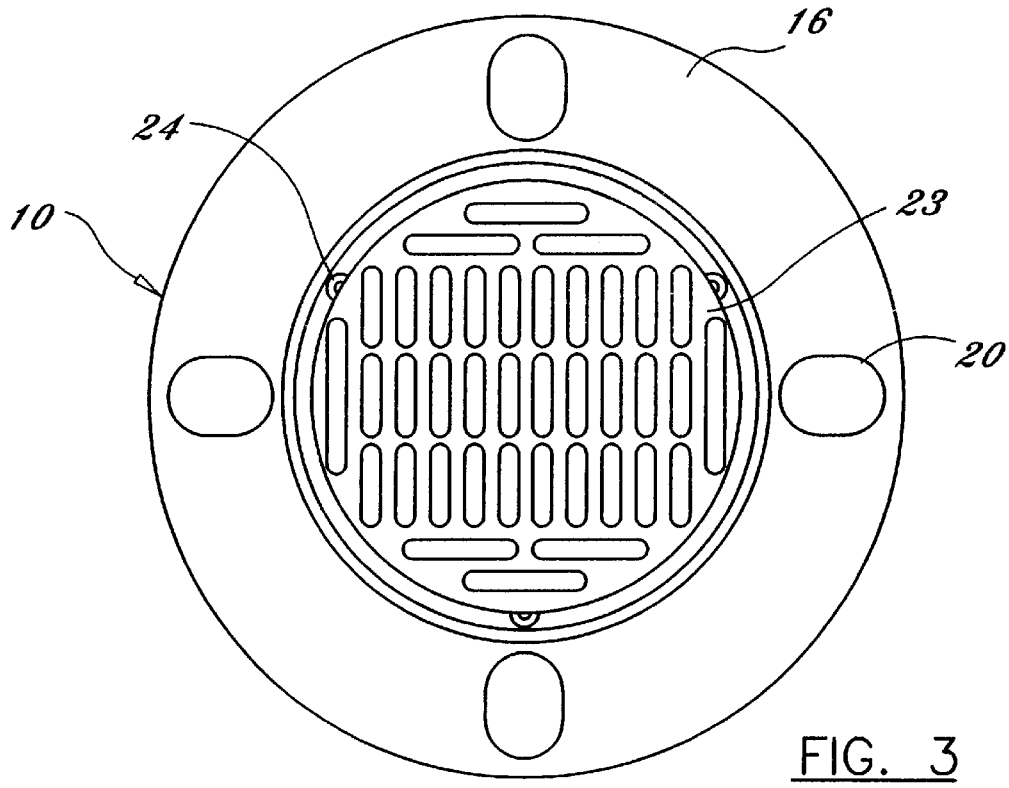
FIG. 3 is a top view of an adjustable catch basin structure in accordance with the present invention.
Figure 4:
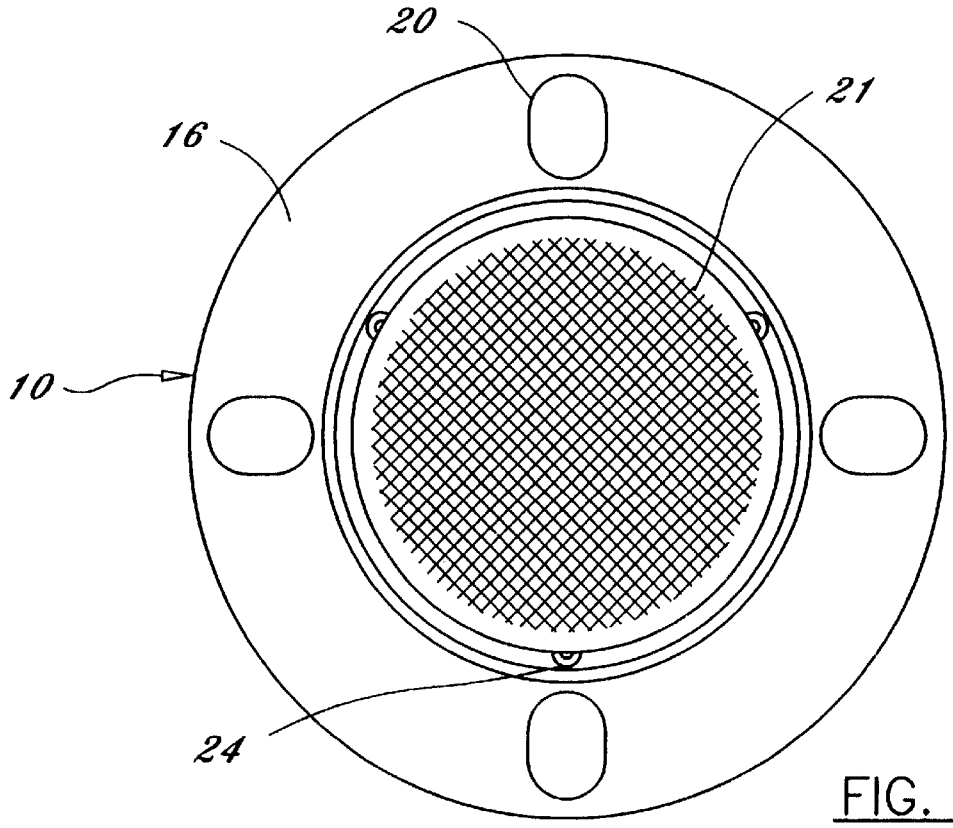
FIG. 4 is a top view of an adjustable manhole structure in accordance with the present invention.

With reference now to the drawings, and particularly to FIG. 2, there is shown a cross-sectional view of an adjustable manhole/catch basin structure 1. The adjustable manhole/catch basin structure 1 includes a mounting base 10, adjustable tube 12, and protection sleeve 14. The mounting base 10 includes a mounting flange 16 and an externally threaded tube 18 which extends upward from the mounting flange 16. The mounting flange 16 and the externally threaded tube 18 may be fabricated a single piece of material or two separate pieces of material. With reference to FIGS. 3 and 4, a plurality of mortar openings 20 are formed through the mounting flange 16.

The protection sleeve 14 is attached to the mounting flange 10 such that thereof is concentric with the externally threaded tube 18. The protection sleeve 14 protects the external threads of the externally threaded tube 18 from exposure to pavement. The adjustable tube 12 is internally threaded such that it threadably engages the externally threaded tube 18. The internal threads on the adjustable tube 12 and the external threads of the externally threaded tube 18 are preferably 1⅜ inch pitch square threads for purposes of strength. The inner diameter 22 of the protection sleeve 14 is large enough to provide clearance for the outer diameter of the adjustment tube 12. Preferably, the clearance between the inner diameter 22 of the protection sleeve 14 and the outer diameter of the adjustable tube 14 is as small as possible.

Figure 2A:
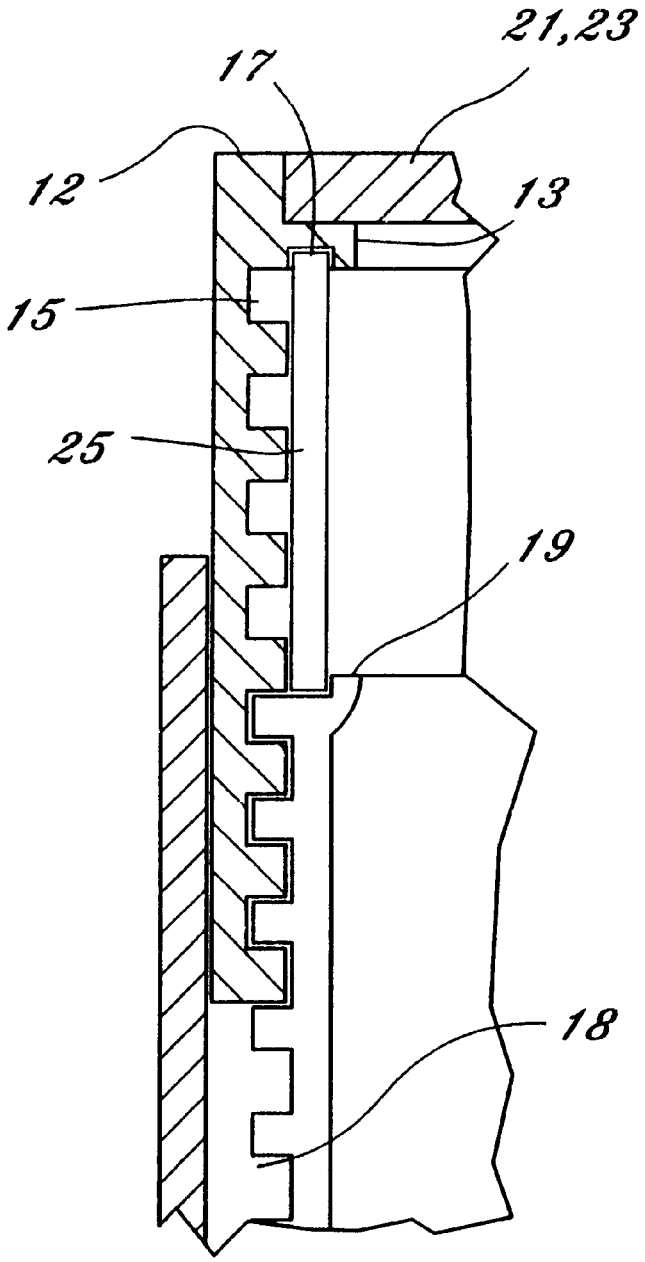
FIG. 2*a* is an enlarged cross-sectional view of a spacer which temporarily maintains the height of the adjustable tube in accordance with the present invention.

With reference to FIG. 2*a,* the adjustable tube 12 includes a cover flange 13 which extends inward from an inner diameter 15 of the adjustable tube 12. The cover flange 13 supports a cover, namely, a manhole cover 21 or a catch basin cover 23. A spacer groove 17 is formed in a bottom of the cover flange 13. A spacer lip 19 is formed on a top of the externally threaded tube 18. The spacer groove and lip are sized to receive a spacer 25. The spacer 25 is used to temporarily retain the adjustable tube 12 in position, before thereof is surrounded with pavement.

Figure 5:
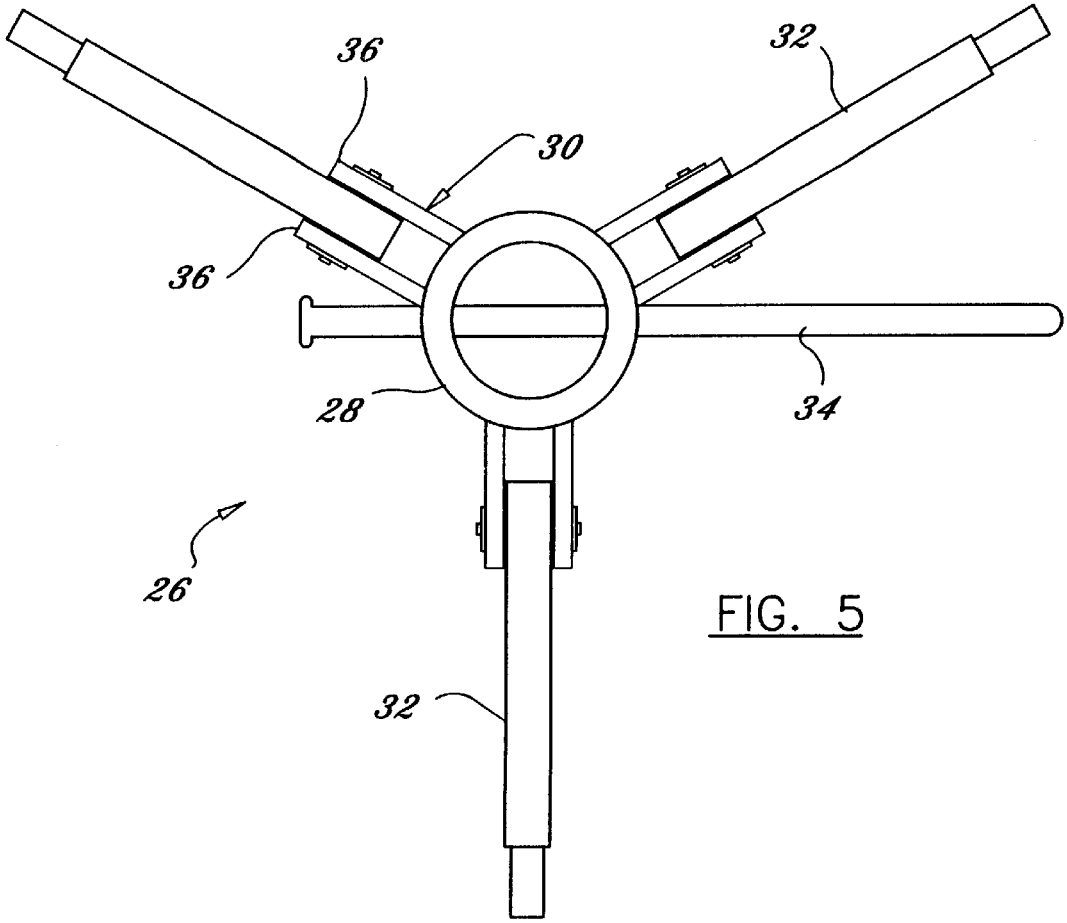
FIG. 5 is a top view of an adjustment tool which is used to rotate an adjustable tube to a desired height in accordance with with the present invention.
Figure 6:
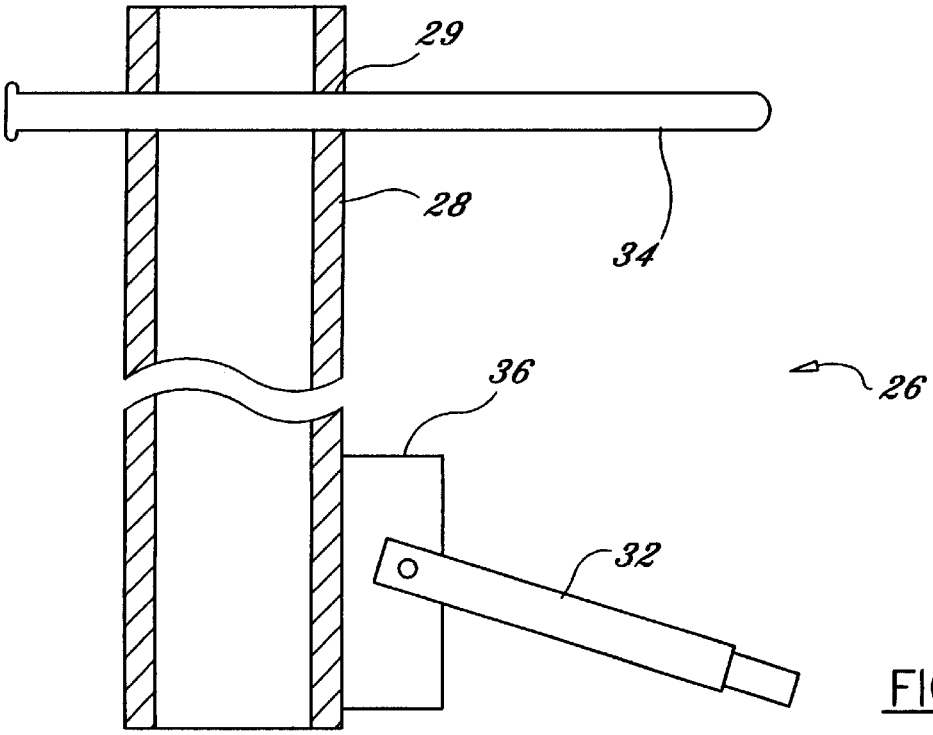
FIG. 6 is a side view of an adjustment tool which is used to rotate an adjustable tube to a desired height in accordance with with the present invention.

With reference to FIGS. 5 and 6, three notches 24 are preferably formed in a top of the adjustment tube 12 to allow an adjustment tool 26 to rotate thereof to the desired height. The adjustment tool 26 includes a body 28, three arm flanges 30, three torque arms 32, and a torque lever 34. One end of each torque arm 32 is sized to fit in one of the notches 24. The body 28 has a bore 29 formed through a top thereof which is sized to receive the torque lever 34. The three arm flanges 30 are disposed around the bottom of the body 28 preferably equidistant from each other. Each arm flange 30 includes two flange plates 36. The distance between the two flange plates 36 is sized to slidably receive a single torque arm 32. The flange plates 36 provide support to each torque arm 32 when thereof is inserted into each notch 24 and the adjustment tool 26 is rotated. To adjust the height of the adjustable tube 12, the end of each of torque arm 32 is inserted into one of the notches 24. The torque lever 34 is inserted into bore 29. The adjustable tool 26 is rotated until the adjustable tube 12 is at the desired height. Other methods of rotating the adjustable manhole/catch basin structure 1 may also be used. A top of the body 28 may be used as a hammer pad to strike the adjustment tube 12 if the threads are corroded.

Figure 1:
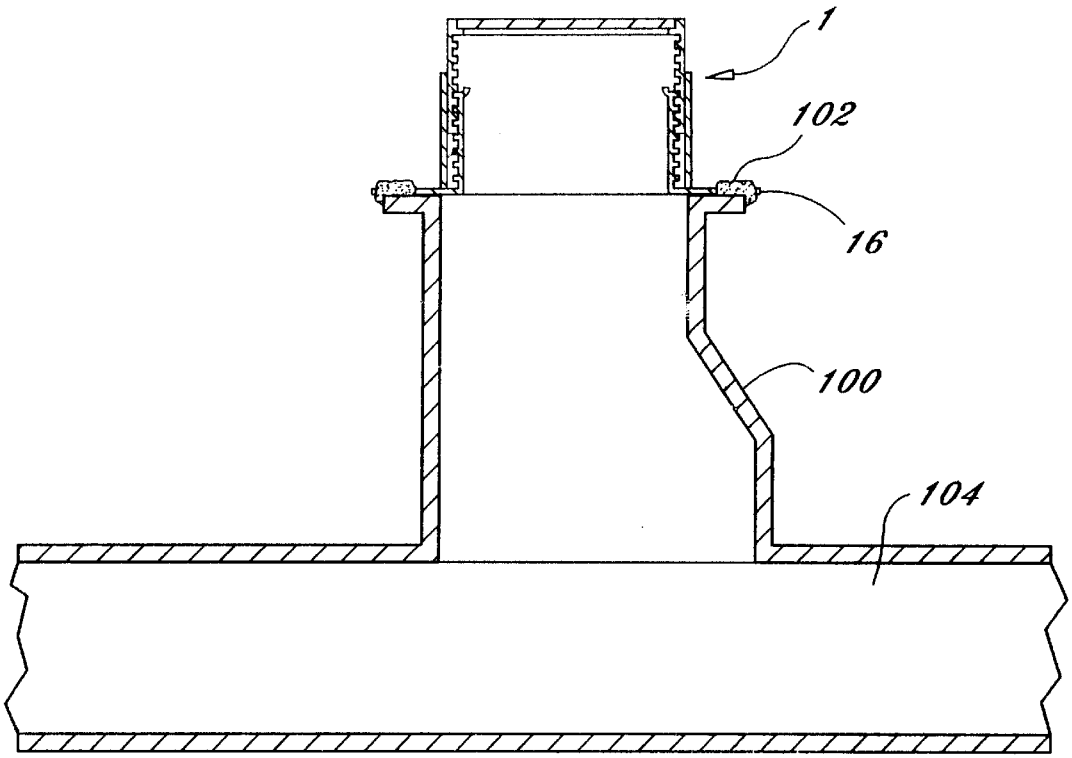
FIG. 1 is a cross-sectional view of an adjustable manhole/catch basin structure attached to a sewer in accordance with the present invention.

With reference to FIG. 1, the adjustable manhole/catch basin structure 1 is placed on top of a concrete lateral 100. The mounting flange is mortared to a top of the concrete lateral 100 by placing mortar 102 inside the mortar openings 20 and on top of the mounting flange 16. The concrete lateral 100 is mounted on a sewer 104. After the mortar 102 has hardened, the adjustment tool 26 is used rotate the adjustment tube 12 to a height of one inch below the road grade 104. After the grade is set, the adjustable tube 12 is rotated to the proper height and the pavement is filled around the adjustment tube 12.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. An adjustable manhole/catch basin structure comprising:

a mounting base including an externally threaded tube attached to a mounting flange;

an adjustable tube having an inner diameter which is threadably enagagable with said externally threaded tube, a cover flange extending inward from said inner diameter at a top thereof;

a cover being placed in said inner diameter on said cover flange; and a protection sleeve is attached to said mounting flange, an internal diameter of said protection sleeve protecting external threads of said externally threaded tube.

2. The adjustable manhole/catch basin structure of claim 1, further comprising:

a plurality of mortar openings being formed through said mounting flange.

3. The adjustable manhole/catch basin structure of claim 1, further comprising:

said cover being a manhole cover.

4. The adjustable manhole/catch basin structure of claim 1, further comprising:

said cover being a catch basin cover.

5. The adjustable manhole/catch basin structure of claim 1, further comprising:

a spacer; and a spacer groove being formed in a bottom of said cover flange, a spacer lip being formed on a top of said externally threaded tube, wherein said spacer fitting in said spacer groove and within said spacer lip, said spacer temporarily supporting said adjustable tube.

6. The adjustable manhole/catch basin structure of claim 1, further comprising:

at least three notches being formed in a top of said adjustable tube.

7. The adjustable manhole/catch basin structure of claim 6, further comprising:

an adjustment tool having a base, three torque arms, and a torque lever; and three arm flanges extending from a bottom of said base, one end of a single said torque arm being pivotally attached to a single said arm flange, the other end of each torque arm being sized to fit in one of said notches.

8. The adjustable manhole/catch basin structure of claim 6, further comprising:

said adjustable tube having internal threads and said externally threaded tube having external threads, said internal and external threads being engagable with each other, said threads being a square type.

9. An adjustable manhole/catch basin structure comprising:

a mounting base including an externally threaded tube attached to a mounting flange, a plurality of mortar openings being formed through said mounting flange;

an adjustable tube having internal threads which are threadably enagagable with external threads of said externally threaded tube, a cover flange extending inward from an inner diameter of said adjustable tube at a top thereof, at least three notches being formed in a top of said adjustable tube;

a cover being placed in said inner diameter on said cover flange;

a protection sleeve being attached to said mounting flange, an internal diameter of said protection sleeve protecting said external threads of said externally threaded tube; and an adjustment tool having a base, three torque arms, and a torque lever, three arm flanges extending from a bottom of said base, one end of a single said torque arm being pivotally attached to a single said arm flange, the other end of each torque arm being sized to fit in one of said notches.

10. The adjustable manhole/catch basin structure of claim 9, further comprising:

said cover being a manhole cover.

11. The adjustable manhole/catch basin structure of claim 9, further comprising:

said cover being a catch basin cover.

12. The adjustable manhole/catch basin structure of claim 9, further comprising:

a spacer; and a spacer groove being formed in a bottom of said cover flange, a spacer lip being formed on a top of said externally threaded tube, wherein said spacer fitting in said spacer groove and with in said spacer lip, said spacer temporarily supporting said adjustable tube.

13. The adjustable manhole/catch basin structure of claim 9, further comprising:

said internal threads of said adjustable tube and said external threads of said externally threaded tube being square threads.

14. A method of adjusting the height of a manhole/catch basin structure comprising the steps of:

attaching a mounting base to a top of a concrete lateral, said mounting base including an externally threaded tube;

engaging internal threads of an adjustable tube with said externally threaded tube;

protecting external threads of said externally threaded tube with a protection sleeve; and placing a cover on a top of said adjustable tube.

15. The method of adjusting the height of a manhole/catch basin structure of claim 14 wherein:

said cover being a manhole cover.

16. The method of adjusting the height of a manhole/catch basin structure of claim 14 wherein:

said cover being a catch basin cover.

* * * * *